US005279223A

United States Patent [19]

Hachiya

[11] Patent Number: 5,279,223

[45] Date of Patent: Jan. 18, 1994

[54] INK FEED ADJUSTING APPARATUS FOR USE IN INK SUPPLY EQUIPMENT

[75] Inventor: Tadashi Hachiya, Kanagawa, Japan

[73] Assignee: Kabushiki Kaisha Tokyo Kikai Seisakusho, Japan

[21] Appl. No.: 62,721

[22] Filed: May 18, 1993

Related U.S. Application Data

[63] Continuation of Ser. No. 900,434, Jun. 18, 1992, abandoned.

[30] Foreign Application Priority Data

Jun. 28, 1991 [JP] Japan ..... 3-58005[U]

[51] Int. Cl.[5] ..... B41F 31/04; B41F 31/06

[52] U.S. Cl. ..... 101/365

[58] Field of Search ..... 101/363, 364, 350, 365, 101/207, 208, 209, 210, 157, 169; 118/261; 15/256.5

[56] References Cited

U.S. PATENT DOCUMENTS

| | | | |
|---|---|---|---|
| 2,837,024 | 6/1958 | Dougan | 101/365 |
| 3,855,927 | 12/1974 | Simeth | 101/365 |
| 4,058,658 | 11/1977 | Hantscho | 101/365 |
| 4,193,345 | 3/1980 | Schoneberger et al. . | |
| 4,318,341 | 3/1982 | Pietsch et al. | 101/365 |
| 4,328,748 | 5/1982 | Schramm . | |
| 4,372,207 | 2/1983 | Toyoda . | |
| 4,393,775 | 7/1983 | Cappel et al. . | |
| 4,393,776 | 7/1983 | Toyoda . | |
| 4,413,561 | 11/1983 | Toyoda . | |
| 4,534,290 | 8/1985 | Schroder et al. . | |
| 4,554,870 | 11/1985 | Fischer . | |
| 4,572,477 | 2/1986 | Phlipot et al. . | |
| 4,587,899 | 5/1986 | Theilacker . | |
| 4,596,187 | 6/1986 | Rüger . | |
| 4,624,183 | 11/1986 | Kunkel et al. . | |
| 4,655,133 | 4/1987 | O'Dea et al. . | |
| 4,711,175 | 12/1987 | Hummel et al. . | |

FOREIGN PATENT DOCUMENTS

| | | | |
|---|---|---|---|
| 46206 | 2/1982 | European Pat. Off. | 101/365 |
| 3728672 | 3/1988 | Fed. Rep. of Germany | 101/DIG. 47 |
| 63-233842 | 9/1988 | Japan . | |
| 1437974 | 6/1976 | United Kingdom . | |

*Primary Examiner*—J. Reed Fisher

*Attorney, Agent, or Firm*—Ronald P. Kananen

[57] ABSTRACT

An ink feed adjusting apparatus for use in an ink supply equipment that includes a plurality of ink feed adjusting members juxtaposed with one another under a top plate so as to adjust the amount ink supplied by moving each of them towards or away from or bringing each of them into contact with the peripheral surface of an ink fountain roller the adjusting members have through-holes formed in each of them and cover members fitted at least in the respective upper parts of these through-holes.

4 Claims, 1 Drawing Sheet

INK FEED ADJUSTING APPARATUS FOR USE IN INK SUPPLY EQUIPMENT

This application is a continuation of application Ser. No. 07/900,434 filed Jun. 18, 1992, now abandoned.

BACKGROUND OF THE INVENTION

1. Field of the Invention

This invention relates to an ink feed adjusting apparatus for use in an ink supply equipment of a printing press, and particularly to an ink feed adjusting apparatus wherein at least upper parts of through-holes respectively formed in a plurality of ink feed adjusting members are blocked with cover members, respectively.

2. Description of the Prior Art

A prior art ink feed adjusting apparatus for use in the above-mentioned ink supply equipment is shown in the publication of Japanese Laid-open Patent Application No. SHO 63-233842.

This ink feed adjusting apparatus comprises a single cover plate 1 between a top plate (which is described as "bottom plate 6 of an ink reservoir" in the above-mentioned publication) and a plurality of juxtaposed ink feed adjusting members (which are described as "ink-keys 2" in the above-mentioned publication), and is constructed such that through-holes (which are described as "perforated portions 3" in the above-mentioned publication) formed in the upper parts of the ink feed adjusting members are blocked simultaneously with the cover plate 1. And, the cover plate 1 is fitted in recesses 3*a* formed in the ink feed adjusting members (ink keys 2) whose depth is nearly equal to the thickness of the cover plate 1 so that it may be slidably moved relative to the top plate (bottom plate 6). This arrangement ensures smooth movement of the ink feed adjusting members (ink keys 2) relative to the top plate (bottom plate 6) and prevents the ink, which makes an inroad underneath the top plate (bottom plate 6) from making an ingress into the through-holes (perforated portions 3). Further, the above-mentioned cover plate 1 has guide projections formed on the lower surface thereof that are adapted to be fitted in the above-mentioned through-holes so as to restrain the cover plate 1 from skewing relative to the ink feed adjusting members (ink keys 2) thereby preventing the occurrence of malfunction or trouble due to useless loading on the driver device of the ink feed adjusting members (ink keys 2).

In the above-mentioned prior art ink feed adjusting apparatus, although the cover plate 1 is prevented by fitting of the guide projections into the through-holes from skewing largely relative to the ink feed adjusting members (ink keys 2), because the cover plate 1 is fitted in the recesses 3*a* formed in the ink feed adjusting members (ink keys 2) it is unavoidable that the cover plate 1 be bent due to difference in setting position between the adjacent ink delivery adjusting members (ink keys 2) so that generation of useless loading on the driver device can not be eliminated. Further, the function of preventing the ink which made an inroad under the top plate (the bottom plate 6) from making an ingress into the through-holes (perforated portions 3) tends to become incomplete. Further, there is no possibility of the cover plate 1 being skewed relative to the ink delivery adjusting members (ink keys 2), but it is unavoidable that the whole of the cover plate 1 slips out of position in parallel relationship with the direction of movement of the ink feed adjusting members (ink keys 2), and therefore to rectify this it is required to spare time to perform rectification work which is not directly connected with the adjustment of the amount of supply of ink.

SUMMARY OF THE INVENTION

The present invention has been made in view of the above-mentioned circumstances in the prior art, and has for its object to provide an ink feed adjusting apparatus for use in an ink supply equipment arranged so as to eliminate the cover plate which tends to slip out of position to thereby eliminate the rectifying operation to eliminate the slip, prevent completely ink or useless substances from making an ingress into the through-holes formed in the upper parts of the individual ink delivery adjusting members, and also to prevent useless loading from being imposed on the driver device upon movement of the ink feed adjusting members for the ink feed adjustment purposes so that malfunctions or difficulties of the ink feed adjusting apparatus due to the aforementioned troubles can be eliminated.

To achieve the above-mentioned object, according to an aspect of the present invention, there is provided an ink feed adjusting apparatus for use in an ink supply equipment, comprising: a plurality of ink feed adjusting members juxtaposed with one another under a top plate so as to adjust the amount of supply of ink by moving each of them towards or away from or bringing each of them into contact with the peripheral surface of an ink fountain roller, and through-holes formed in these ink feed adjusting members, respectively, characterized in that the above-mentioned ink feed adjusting members have cover members, respectively, fitted at least in the upper parts of their respective through-holes.

As mentioned above, since at least the upper parts of the respective through-holes of the ink feed adjusting members are blocked individually with cover members, the ingress of the ink, etc. into these perforated portions is prevented, and also independence of each of the ink feed adjusting members juxtaposed with one another is secured irrespective of the adjacent ink feed adjusting members. Consequently, upon conducting adjustments of the amount of supply of the ink, each of the ink feed adjusting members is moved along the sides of the adjacent ink feed adjusting members with which both sides thereof are held in contact serving as the guides thereof with the result that useless loading is not imposed on the driver device thereof.

The above-mentioned and other objects, aspects and advantages of the present invention will become apparent to those skilled in the art by making reference to the following detailed description and the accompanying drawings in which a preferred embodiment incorporating the principles of the present invention is shown by way of example only.

DETAILED DESCRIPTION OF THE PREFERRED EMBODIMENT

The present invention will now be described below in detail by way of a preferred embodiment with reference to the accompanying drawings.

Figure 1:
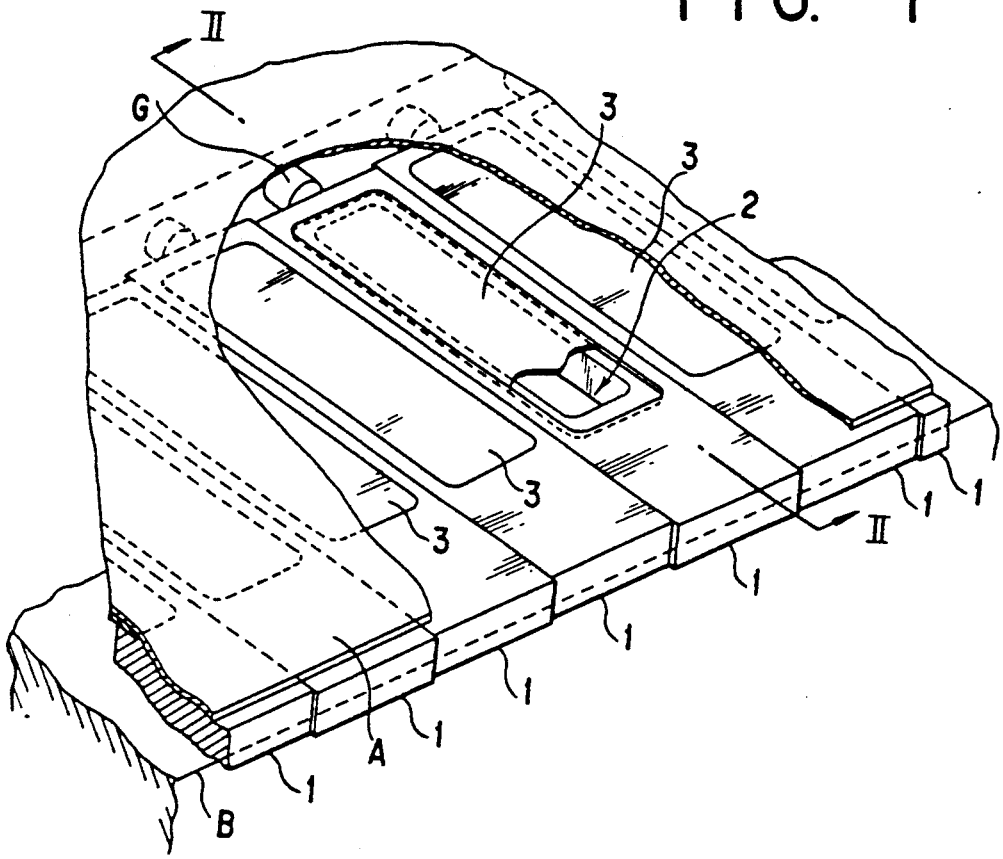
FIG. 1 is a schematic, partially cut-away perspective view showing principal parts of one embodiment of the present invention.
Figure 2:
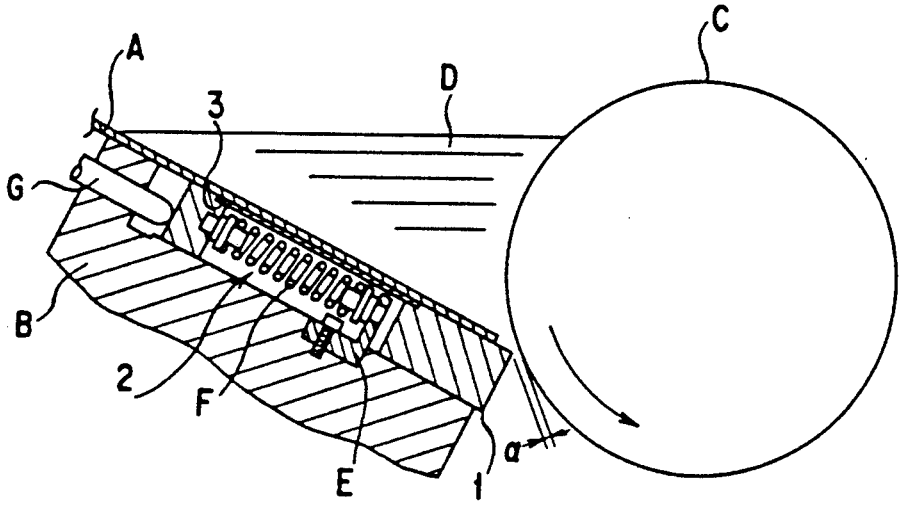
FIG. 2 is a sectional view taken along line II—II in FIG. 1.

Referring to FIGS. 1 and 2, a plurality of ink feed adjusting members 1 are juxtaposed in a direction parallel with the axis of an ink feed roller C, with their upper and lower surfaces being held in contact with the lower surface of a top or crown plate A and the upper surface of a base member B, respectively, thereby forming an ink delivery adjusting apparatus for feeding an ink D stored in the space defined between the ink fountain roller C and the top plate A by the action of the peripheral surface of the ink feeding roller C so as to supply it into the downstream side of an ink supply flow, not shown, while the amount of supply of the ink is being adjusted by varying the clearance $\alpha$ defined between the leading edge of the ink feeding adjusting member 1 and the peripheral surface of the ink fountain roller C.

Each of the ink feeding adjusting members 1 has a through-hole 2 formed so as to extend from the upper surface thereof to the bottom surface thereof, and a forcing member F is mounted between the inner surface of one end wall or the rear wall of the through-hole 2 and a retainer member E fixedly secured to the base member B so as to always force the ink feed adjusting members 1 in such a direction as to recede from the peripheral surface of the ink fountain roller C. Stating more specifically, the forcing member F serves as a driving device for always forcing the ink feed adjusting members 1 away from the peripheral surface of the ink delivery roller C. Further, each of the through-holes 2 has a stepped portion formed along the periphery of the upper part thereof, in which a cover member 3 whose thickness is nearly equal to the depth of the stepped portion is fitted closely with grease or the like (not shown) applied therebetween.

Further, a pusher member G is abutted against the outer end or rear end of each of the ink feed adjusting members 1 so that it may be driven by a driver device (not shown), which serves as a driving device, so as to push against the ink feed adjusting member 1 towards the peripheral surface of the ink fountain roller C in opposition to the biasing force of the above-mentioned forcing member F.

According to the above-mentioned construction, when the driver device, not shown, is driven so as to move the pusher member G forwards or backwards, the ink feed adjusting member 1 is moved towards or away from or into contact with the periphery surface of the ink fountain roller C in opposition to or through the action of the force of the forcing member F along the sides of the adjacent ink feed adjusting members 1 with which both sides thereof are held in contact serving as the guides thereof so that the clearance $\alpha$ between the leading edge of the ink feed adjusting member 1 and the peripheral surface of the ink fountain roller C is varied. As the ink fountain roller C is rotated in the direction shown by arrow in FIG. 2, the ink D stored in the space defined between the top plate A and part of the peripheral surface of the ink fountain roller C is sent out onto the peripheral surface at a thickness decided by the above-mentioned clearance $\alpha$, and then supplied to the downstream side of the ink supply flow, not shown.

While the ink makes an inroad between the top plate A and the ink feed adjusting member 1 when the ink feed adjusting member 1 is moved towards or away from the peripheral surface of the ink fountain roller C, the ingress of the ink into the through-hole 2 is prevented by the cover member 3.

Further, upon conducting change of the ink for color changeover, it is necessary to remove the ink which made an ingress between the top plate A and the ink feed adjusting members 1, however because the upper surfaces of the ink feed adjusting members 1 are kept substantially flush by the provision of the cover members 3 the cleaning operation can be made very easily and in a short time.

Further, since independence of each of the ink feed adjusting members 1 is secured when each of the ink feed adjusting members 1 is moved towards or away from the peripheral surface of the ink fountain roller C, there is no possibility of the driver means being imposed with useless loading.

By carrying the present invention into effect, in the ink feed adjusting apparatus comprising a plurality of ink feed adjusting members 1 juxtaposed with one another under the top plate A, the ink which made an ingress between the top plate A and the ink feed adjusting members 1 can be prevented from making an inroad into the through-holes 2 of the ink feed adjusting members 1, and also since the upper surfaces of the ink feed adjusting members 1 are kept substantially flush by the provision of the cover members 3, the operation of removing the ink which made an ingress between the top plate and the ink feed adjusting members can be done very easily and in a short time when a change of the ink for a color changeover is made, thereby improving the operational efficiency.

Further, since each of the ink feed adjusting members 1 including the cover members 3 is kept in independent condition, the individual ink feed adjusting members 1 can be moved smoothly when adjustment of the amount of supply of ink is made, and also useless loading is not imposed on the driver device thereof, which contributes greatly to the maintenance and improvement of the accuracy and durability of the mechanism of the ink feed adjusting apparatus.

It should be understood that the foregoing description relates to only a preferred embodiment of the present invention, and that it is intended to cover all changes and modifications of the example of the invention herein chosen for the purpose of the disclosure, which do not constitute departures from the spirit and scope of the present invention.

What is claimed is:

1. An ink feed adjusting apparatus for use in an ink supply equipment including an ink fountain roller and a top plate between which an ink is stored, said ink feed adjusting apparatus comprising:

a base member;

a plurality of ink feed adjusting members mounted on said base member and juxtaposed in a direction parallel with the axis of the ink fountain roller, each of said ink feed adjusting members being provided with a through hole penetrating upper and lower surfaces thereof and provided with a first end portion constituting a first outer surface facing the ink fountain roller with an adjustable gap through which the ink is fed and an inner surface forming a wall of the through hole, said through hole having a stepped recess portion and an individual cover plate tightly mounted to said stepped recess portion, said cover plate having a thickness substantially equal to a depth of the stepped recess portion to provide a flush surface with respect to the ink feed adjusting member;

a forcing means disposed in the through hole of each said ink feed adjusting member for urging the respective ink feed adjusting member in a direction for retracting the ink feed adjusting member from the ink fountain roller; and a pushing means disposed so as to abut against a second end portion constituting a second outer surface of each said ink feed adjusting member for urging the respective ink feed adjusting member towards the ink fountain roller.

2. An apparatus according to claim 1, wherein said forcing means has end portions connected to inner walls of the through hole.

3. An apparatus according to claim 1, further comprising a retainer members secured to the base member so as to force the ink feed adjusting members in a direction to recede from a peripheral surface of the ink fountain roller.

4. An ink feed adjusting apparatus for use in ink supply equipment including an ink fountain roller and a top plate between which ink is stored, said ink feed adjusting apparatus comprising:

a base member;

a plurality of ink feed adjusting members mounted on said base member under the top plate and arranged in a direction parallel with the axes of the ink fountain roller, each of said ink feed adjusting members having a through hole formed therein open to the top plate, each of said through holes having an individual cover member fitted flush across the through hole sealing the through hole from said top plate, said cover member and said top plate being arranged to allow a sliding relationship between them; and a forcing means disposed in the through hole of each said ink feed adjusting member for urging the respective ink feed adjusting member in a direction away from said ink fountain roller.

* * * * *